United States Patent [19]

Griffee

[11] 4,410,893

[45] Oct. 18, 1983

[54] DUAL BAND COLLINEAR DIPOLE ANTENNA

[75] Inventor: Leslie V. Griffee, Dallas, Tex.

[73] Assignee: Rockwell International Corporation, El Sequndo, Calif.

[21] Appl. No.: 314,948

[22] Filed: Oct. 26, 1981

[51] Int. Cl.[3] ..... H01Q 9/28

[52] U.S. Cl. ..... 343/792; 343/801; 343/821

[58] Field of Search ..... 343/790–792, 343/801, 807, 808, 821

[56] References Cited

U.S. PATENT DOCUMENTS 3,727,231 4/1973 Galloway et al. ..... 343/813

*Primary Examiner*—Eli Lieberman

*Attorney, Agent, or Firm*—Michael E. Taken; V. Lawrence Sewell; Howard R. Greenberg

[57] ABSTRACT

A collinear dual dipole antenna is split into two sections which are connected by a central conductor extending in spaced parallel relation within hollow support mast sections, and forming an effective transmission line providing RF continuity at a high band frequency f, and discontinuity at a low band frequency ½ f. The configuration provides a dual band antenna operating in either band from a single source without filtering and without modification of the antenna. In the high frequency band, the antenna operates as a dual dipole array. In the low frequency band, the antenna operates as a single dipole array with each mast section and its respective dipole acting as half of the single dipole array.

8 Claims, 2 Drawing Figures

DUAL BAND COLLINEAR DIPOLE ANTENNA

TECHNICAL FIELD

The invention relates to electromagnetic radiating antennas, and more particularly to a dipole antenna radiating different frequency bands from a single feed source without altering the antenna.

SUMMARY AND SUMMARY

The present invention provides a simple and efficient conversion of the collinear dipole antenna disclosed in my U.S. Pat. No. 3,727,231 into a dual band antenna.

A need for a dual band implementation has arisen in one exemplary application in conjunction with military use wherein one armed forces branch uses a given band for communication and another branch uses a different band for communication, and cooperative maneuvers require intercommunication between the branches. For example, one antenna designed in accordance with my previous said patent operates in the 225–400 MHz range. Another band used by a different service branch is 108–152 MHz. One way of achieving intercommunication is by merely installing a second antenna suited for the second frequency band. It is desirable to avoid the inefficiency of two separate antennas, and instead use a dual band antenna which is capable of radiating each band.

Various dual band antennas are known. These antennas typically have two input feeds and use high patch and low patch filters for separating the two bands.

The present invention enables an extremely simple modification of an existing antenna to afford dual band operation. The antenna requires no filtering, and uses a single input. The antenna radiates a high band frequency f, and without modification radiates a low band frequency $\frac{1}{2}$ f when the latter is fed thereto. The configuration of the antenna enables it to operate as a dual dipole array at the high band frequency f, and to operate as a single dipole array at the low band frequency $\frac{1}{2}$ f.

DETAILED DESCRIPTION

Figure 1:
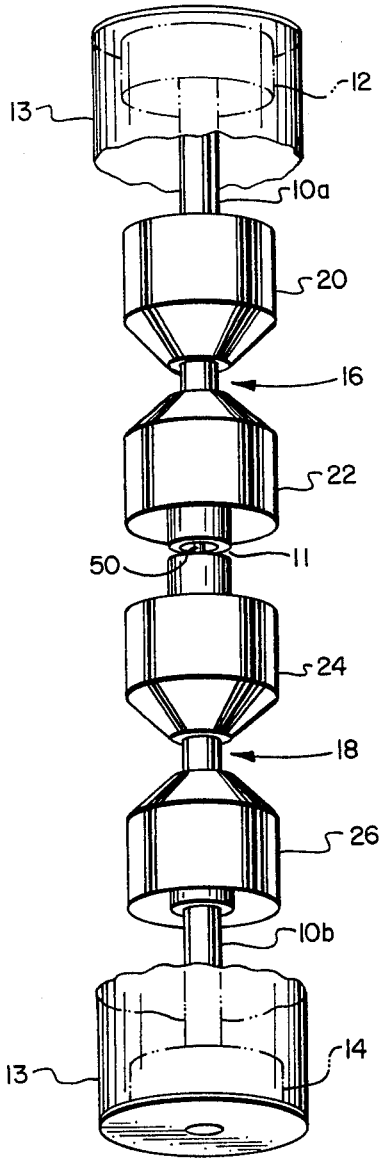
FIG. 1 is an isometric view like that in my said U.S. Pat. No. 3,727,231, and shows a collinear dipole antenna in accordance with the present invention.

Like reference characters are used from my said U.S. Pat. No. 3,727,231 where appropriate to facilitate understanding, which patent is incorporated herein by reference.

The central hollow mast 10 of said patent is split into upper and lower sections 10*a* and 10*b* by a transverse annular gap 11, FIG. 1. This mast is provided with support members 12 and 14 at either end which receive cylindrical housing member 13, shown broken away, such as a fiberglass radome, which secures the mast sections 10*a* and 10*b* in spaced facing collinear relation. Mounted collinearly on respective mast sections are two bicone dipoles 16 and 18. Conical elements 20 and 22 are insulatively mounted on mast section 10*a* and comprise bicone 16; similarly, conical elements 24 and 26 are insulatively mounted on mast section 10*b* and comprise bicone 18. The bicones function as radiating dipoles at a high band frequency f in which the radiation pattern is omnidirectional towards the horizon, as in said patent.

Figure 2:
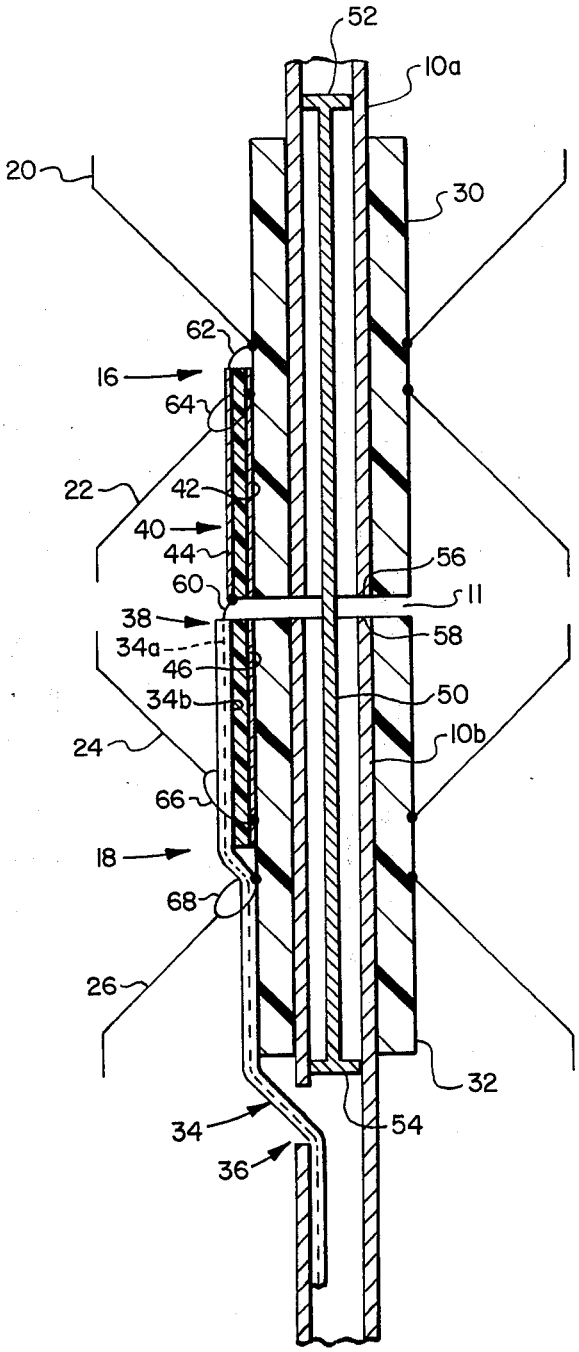
FIG. 2 is a schematic view like that in my said U.S. Pat. No. 3,727,231, and shows the antenna of FIG. 1 in section, illustrating the feed system and effective transmission line system between the gapped sections.

Further as in said patent, the two biconical arrays 16 and 18 are insulatively mounted on mast 10 by insulators 30 and 32, FIG. 2, which function as quarterwise chokes at the center frequency of the high band. Coaxial feed line 34 which is preferably situated within mast 10 is passed externally at point 36 and terminates at a point 38 equidistant between bicones 16 and 18. Extending from point 38 to the input of bicone 16 is a stripline 40 including base plane 42 and top conductor 44. The inner conductor 34*a* of coaxial line 34 is ohmically connected to the top conductor 44 which in turn is ohmically connected to the upper cone 20 of bicone 16. Ground plane 42 is ohmically connected to the bottom cone 22. Extending from point 38 downwardly to bicone 18 is a conductor 46 which cooperatively functions with the other conductor 34*b* of coaxial line 34 as a second stripline. Conductor 46 is ohmically connected to upper cone 24 of bicone 18, and the outer conductor 34*b* of coaxial line 34 is ohmically connected to the bottom cone 26 of bicone 18.

The present invention splits the support means or mast 10 into two sections by means of gap 11. The invention further provides an effective transmission line between the upper and lower mast sections by means of central bridging conductor 50 extending in spaced parallel relation within the mast. Conductor 50 spans gap 11 and extends a predetermined depth into each mast section 10*a* and 10*b*. Conductor 50 ohmically engages the inner wall of the mast at top and bottom conductor ends 52 and 54. The predetermined depth that central conductor 50 extends into each mast section is equal to a half wavelength path at the high band frequency f. For example, if the high frequency band is 225–400 MHz, and taking the center frequency as roughly 300 MHz, then a half wavelength at 300 MHz is about 50 centimeters. The distance from top end 52 to mast edge 56 is thus about 50 centimeters in this example.

As above noted, coaxial cable 34 terminates at point 38 midway between dipoles 16 and 18. This midway feed point 38 is adjacent gap 11 such that signal potential at feed point 38 sees the same distance to each of ends 52 and 54. Central conductor 50 and mast section 10*a* form an effective transmission line as seen from feed point 38. In accordance with well known transmission line principles, a half wavelength path down a transmission line appears as a low impedance short circuit path, i.e., point 52 appears shorted to mast edge 56 at about zero impedance. Likewise, bottom end 54 appears shorted to mast edge 58 at about zero impedance. Since feed point 38 sees equal low impedances at points 56 and 58, there is effective continuity along mast sections 10*a* and 10*b* across gap 11 at the high band frequency.

The dividing of the mast into two sections 10*a* and 10*b* would normally prevent the high band from functioning properly since its stripline feed system requires RF continuity at the center point. The half wavelength path provided by transmission line means 50 at the high band frequency makes the mast appear as being continuous. It is to be noted that a half wavelength path includes all integral multiples of $\frac{1}{2}\lambda$, i.e., $\lambda$, $3/2\ \lambda$, $2\ \lambda$, $5/2\ \lambda$, etc., and this is the meaning of half wavelength path as used herein.

In high band operation, inner conductor 34*a* of the coaxial cable, for example having a positive signal, conducts a positive charge to conductor 44 by means of ohmic connection 60. Conductor 44 conducts this positive charge to the upper element 20 of dipole 16 by means of ohmic connection 62. Conductor 44 induces or field couples a negative charge on reference plan conductor 42 on the other side of stripline means 40. Conductor reference plane 42 conducts this negative charge to the bottom element 22 of dipole 16 by means of ohmic connection 64. Dipole 16 thus radiates a field from positive element 20 out into space which is returned and referenced to negative element 22.

The negative outer conductor 34*b* of coaxial cable 34 induces or field couples a positive charge on conductor reference plane 46 on the other side of the lower stripline means. Conductor reference plane 46 conducts this positive charge by means of ohmic connection 66 to the upper element 24 of dipole 18. Outer conductor 34*b* of the coaxial cable is ohmically connected by means of connection 68 to the lower element 26 of dipole 18. Dipole 18 thus radiates a field from positive plate 24 out into space which is returned and referenced to negative plate 26. Since feed point 38 is midway between the dipoles, the dipoles radiate in phase because of the equal travel lengths thereto from the feedpoint, and because of the polarities, i.e., upper plates 20 and 24 are both positive, for example. At the high band frequency f, the antenna thus operates as a dual dipole array with each dipole 16 and 18 radiating a field.

In order for field coupling to occur and the noted charge to be induced on reference planes 42 and 46, there must be a continuous ground return reference plane provided by mast 10. That is, there must be, or appear to be, continuity across mast sections 10*a* and 10*b*. This continuity is effectively provided by transmission line means 50 at the high frequency band.

The distance between points 56 and 52, and between points 58 and 54, determine continuity across mast sections 10*a* and 10*b* relative to the frequency band. As noted, the distance from point 52 to point 56 is a half wavelength path at a high band frequency f. This same spacial distance from point 52 to 56 is a quarter wavelength path at a frequency ½ f. In accordance with known transmission line principles, a quarter wavelength path appears as a high impedance open circuit. Thus, at a low band frequency ½ f, feed point 38 sees a high impedance or open circuit when looking into each of the upper and lower mast sections from gap 11. That is, the signal from feed point 38 sees a high impedance or open circuit at each of points 56 and 58, and thus there is discontinuity between mast sections 10*a* and 10*b*. The high impedance open circuit along a transmission line appears at all odd multiples of ¼λ, i.e., at ¼λ, ½λ, 5/4 λ, 7/4 λ, etc., and this is the meaning used herein for quarter wavelength path.

In low band operation at frequency ½ f, there is discontinuity between the upper and lower mast sections 10*a* and 10*b*. Because of this discontinuity, there is no common continuous ground return reference plane for the conductor reference planes 42 and 46. Thus, there is no field coupling or charge induced on these latter, and instead the charge from midpoint 38 accumulates at the facing edges 56 and 58 of the mast sections across gap 11. This accumulation of charge causes each mast section to operate as half of a single dipole, rather than as a dual dipole array. Upper mast section 10*a* and all of its parts are half of the new single dipole array, and lower mast section 10*b* and all of its parts are the other half of the now single dipole array. Upper mast section 10*a*, dipole 16 and member 12 radiate a field out into space which is returned and referenced to the other half of the single dipole array which is lower mast section 10*b*, dipole 18 and member 14.

It is thus seen that at the high band frequency f, there is apparent continuity across gap 11 along mast sections 10*a* and 10*b*, and the antenna operates as a dual dipole array with each dipole 16 and 18 radiating a field. At the low band frequency ½ f, there is discontinuity between the mast sections, and the antenna operates as a single dipole array with each mast section and its respective dipole acting as half of the single dipole array.

It is recognized that various modifications are possible within the scope of the appended claims.

I claim:

1. A dual band dipole antenna comprising:

support means with spaced first and second sections;

a pair of dipoles mounted on respective said first and second support means sections;

feed means for energizing said dipoles; and transmission line means between said first and second support means sections providing a low impedance path for continuity therebetween at a high band frequency f, and providing a high impedance path for discontinuity therebetween at a low band frequency ½ f, such that at the high band frequency f, said antenna operates as a dual dipole array, and such that at the low band frequency ½ f, said antenna operates as a single dipole array with each support means section and its respective dipole acting as half of the single dipole array.

2. The invention according to claim 1 wherein said transmission line means provides a low impedance short circuit half wavelength path from said feed means at said high band frequency f, and provides a high impedance open circuit quarter wavelength path from said feed means at said low band frequency ½ f.

3. The invention according to claim 2 wherein:

said transmission line means comprises a bridging conductor extending in spaced parallel relation with said support means sections and ohmically connected to each at a predetermined distance from the facing ends thereof, said predetermined distance equal to said half wavelength path at said high band frequency f.

4. The invention according to claim 2 wherein:

said support means comprises a hollow cylindrical mast having an annular gap splitting the mast into first and second facing collinear sections; and said transmission line means comprises a central conductor within said mast spanning said gap and extending into each section in spaced parallel relation therewith, and including means ohmically connecting said central conductor to the inner wall of said mast at a predetermined depth equal to said half wavelength of said high band frequency f.

5. A dual band collinear dipole antenna comprising:

a hollow cylindrical vertical support mast having a transverse annular gap spliting the mast into upper and lower sections;

a central vertical conductor extending in spaced parallel relation within said mast spanning said gap and extending a predetermined depth into each section, said central conductor having top and bottom ends ohmically engaging the inner wall of said mast;

upper and lower dipoles mounted on respective said upper and lower mast sections;

coaxial feed means supplying said dipoles in phase from a feedpoint midway therebetween adjacent said gap;

said central conductor forming a transmission line with the inner wall of said mast from said feedpoint to each said top and bottom end, said predetermined depth equal to a half wavelength path at a high band frequency f, and equal to a quarter wavelength path at a low band frequency ½ f;

such that at the high band frequency f, there appears to be continuity between said mast sections across said gap such that said mast appears as a continuous ground return reference and each said dipole radiates a field, whereby said antenna operates as a dual dipole array;

and such that at the low band frequency ½ f, there is discontinuity between said mast sections such that one mast section and its respective said dipole is the reference for the other mast section and its respective said dipole, whereby said antenna operates as a single dipole array with a field radiated from one mast section and its respective said dipole as half of the single dipole array and returned and referenced to the other mast section and its respective said dipole as the other half of the single dipole array.

6. A dual band collinear dipole antenna comprising:

a two piece support mast having spaced upper and lower collinear sections;

two dipoles insulatively mounted collinearly on respective said mast sections;

lower stripline means comprising a reference plane extending from a feedpoint midway between said dipoles to the lower said dipole;

upper stripline means comprising a reference plane and a conductor extending from said feedpoint to the upper said dipole;

coaxial feed means extending parallel to said lower stripline means and termininating at said feedpoint, the outer conductor of said coaxial feed means interacting with said reference plane of said lower stripline means for field coupling therewith;

means ohmically connecting the inner conductor of said coaxial feed means to said conductor of said upper stripline means;

means ohmically connecting said conductor of said upper stripline means to one element of said upper dipole;

means ohmically connecting said reference plane of said upper stripline means to the other element of said upper dipole;

means ohmically connecting said reference plane of said lower stripline means to one element of said lower dipole;

means ohmically connecting said outer conductor of said coaxial feed means to the other element of said lower dipole; and transmission line means between said upper and lower mast sections providing a low impedance path for continuity therebetween at a high band frequency f, and providing a high impedance path for discontinuity therebetween at a low band frequency ½ f, such that at the high band frequency f said antenna operates as a dual dipole array with each dipole radiating in phase, and such that at the low band frequency ½ f said antenna operates as a single dipole array with each mast section and its respective dipole acting as half of the single dipole array.

7. The invention according to claim 6 wherein:

said transmission line means comprises a briding conductor extending in spaced parallel relation with said mast sections and ohmically connected to each at a predetermined distance from said feedpoint;

said feedpoint is adjacent the facing ends of said mast sections;

said predetermined distance equals a half wavelength path at said high band frequency f;

such that at said high band frequency f, there appears to be continuity between said mast sections such that said mast appears as a continuous ground return reference for both said reference planes of said lower and upper stripline means, and each said dipole radiates a field, whereby said antenna operates as a dual dipole array;

and such that at said low band frequency ½ f, there is discontinuity between said mast sections and no common continuous ground return reference for said reference planes of said lower and upper stripline means, such that one mast section and its respective said dipole is the reference for the other mast section and its respective said dipole, whereby said antenna operates as a single dipole array with a field radiated from one mast section and its respective said dipole as half of the single dipole array and returned and referenced to the other mast section and its respective said dipole as the other half of the single dipole array.

8. The invention according to claim 7 wherein:

said support mast comprises a hollow cylindrical mast having a transverse annular gap splitting the mast into said upper and lower sections; and said transmission line means bridging conductor comprises a central conductor in spaced parallel relation within said mast spanning said gap, with top and bottom ends ohmically engaging the inner walls of said mast.

* * * * *